US009366472B2

(12) United States Patent
Seo et al.

(10) Patent No.: US 9,366,472 B2
(45) Date of Patent: Jun. 14, 2016

(54) DOOR ASSEMBLY AND REFRIGERATOR HAVING THE SAME

(71) Applicant: LG ELECTRONICS INC., Seoul (KR)

(72) Inventors: Woonkyu Seo, Seoul (KR); Soonho Jung, Seoul (KR); Jinhee Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/226,787

(22) Filed: Mar. 26, 2014

(65) Prior Publication Data

US 2014/0327353 A1 Nov. 6, 2014

(30) Foreign Application Priority Data

Apr. 5, 2013 (KR) ..... 10-2013-0037637

(51) Int. Cl.

| | |
|---|---|
| ***F25D 23/02*** | (2006.01) |
| ***E05D 7/00*** | (2006.01) |
| ***E05F 15/603*** | (2015.01) |
| ***E05F 15/70*** | (2015.01) |

(52) U.S. Cl.

CPC ..... *F25D 23/028* (2013.01); *E05D 7/00* (2013.01); *E05F 15/603* (2015.01); *E05F 15/70* (2015.01); *E05Y 2900/31* (2013.01); *F25D 2323/021* (2013.01); *F25D 2323/024* (2013.01); *F25D 2700/04* (2013.01)

(58) Field of Classification Search

CPC .... F25D 23/028; F25D 2323/024; E05F 3/20; E05F 15/60; E05F 15/603; E05F 15/611; Y10T 16/522; E05D 7/00; E05D 7/08; E05Y 2900/31; A47B 96/04

USPC ..... 312/401, 405, 405.1, 326, 329, 109; 62/449; 49/333, 334

See application file for complete search history.

(56) References Cited

U.S. PATENT DOCUMENTS 4,341,083 A * 7/1982 Ibrahim et al. ..... 62/82
4,609,234 A * 9/1986 Naniwa et al. ..... 312/296

(Continued)

FOREIGN PATENT DOCUMENTS

CN 102012145 A 4/2011
CN 102419052 A 4/2012

(Continued)

OTHER PUBLICATIONS

European Search Report dated Jun. 1, 2015 issued in Application No. 14154942.8.

*Primary Examiner* — James O Hansen
(74) *Attorney, Agent, or Firm* — KED & Associates, LLP

(57) ABSTRACT

A door coupling and rotation assembly and a refrigerator having the same are provided. The refrigerator may include a main body having a storage compartment, at least one door to open and close the storage compartment, and a door coupling and rotation assembly that rotatably couples the at least one door to the main body. A door opening/closing determination device may determine whether or not a user wishes to open the door, and a controller may drive at least one motor in response a signal sensed by the door opening/closing determination device to open or close the at least one door. The assembly may include a hinge bracket coupled to the main body, a hinge shaft coupled to the hinge bracket and defining an axis of rotation of the door, and a motor coupled to the hinge shaft to rotate the at least one door in a forward or reverse direction.

15 Claims, 9 Drawing Sheets

(56) References Cited

U.S. PATENT DOCUMENTS

| | | | | |
|---|---|---|---|---|
| 2004/0103584 | A1 | 6/2004 | Freeman | |
| 2006/0097612 | A1* | 5/2006 | Park | 312/405 |
| 2008/0083243 | A1* | 4/2008 | Lee et al. | 62/446 |
| 2009/0255185 | A1* | 10/2009 | Schachtl et al. | 49/334 |
| 2010/0018240 | A1 | 1/2010 | Hecht et al. | |
| 2010/0141107 | A1* | 6/2010 | Kim et al. | 312/405 |
| 2010/0231111 | A1* | 9/2010 | Kang et al. | 312/405 |
| 2010/0283367 | A1* | 11/2010 | Coleman et al. | 312/405 |
| 2011/0050065 | A1* | 3/2011 | Lee | E05B 17/0033 312/402 |
| 2011/0083461 | A1* | 4/2011 | Kim | 62/264 |
| 2011/0152024 | A1* | 6/2011 | Kuehl | 474/166 |

FOREIGN PATENT DOCUMENTS

| | | | |
|---|---|---|---|
| CN | 102628632 | A | 8/2012 |
| DE | 10 2011 010 906 | A1 | 8/2012 |
| JP | 01-179885 | A | 7/1989 |
| JP | 2002-257466 | A | 9/2002 |
| JP | 2003-090661 | A | 3/2003 |
| JP | 2005-120697 | A | 5/2005 |
| JP | 2005-127527 | A | 5/2005 |
| JP | 2005-299314 | A | 10/2005 |
| JP | 2006-078001 | A | 3/2006 |
| JP | 2010-025461 | A | 2/2010 |
| KR | 10-2009-00439 93 aA | | 5/2009 |

* cited by examiner

DOOR ASSEMBLY AND REFRIGERATOR HAVING THE SAME

CROSS-REFERENCE TO RELATED APPLICATION(S)

This application claims priority under 35 U.S.C. §119 to Korean Application No. 10-2013-0037637 filed in Korea on Apr. 5, 2013, whose entire disclosure is hereby incorporated by reference.

BACKGROUND

1. Field

This relates to a door assembly and a refrigerator having the same.

2. Background

A refrigerator may supply cold air generated by driving of a refrigeration cycle to store items in a low temperature state. To access items stored in the interior of the refrigerator, a user may use at least one hand to grip a handle and open a door. User convenience may be enhanced by providing easier access to the interior of the refrigerator without adversely impacting interior capacity of the refrigerator.

BRIEF DESCRIPTION OF THE DRAWINGS

The embodiments will be described in detail with reference to the following drawings in which like reference numerals refer to like elements wherein.

DETAILED DESCRIPTION

Figure 1:
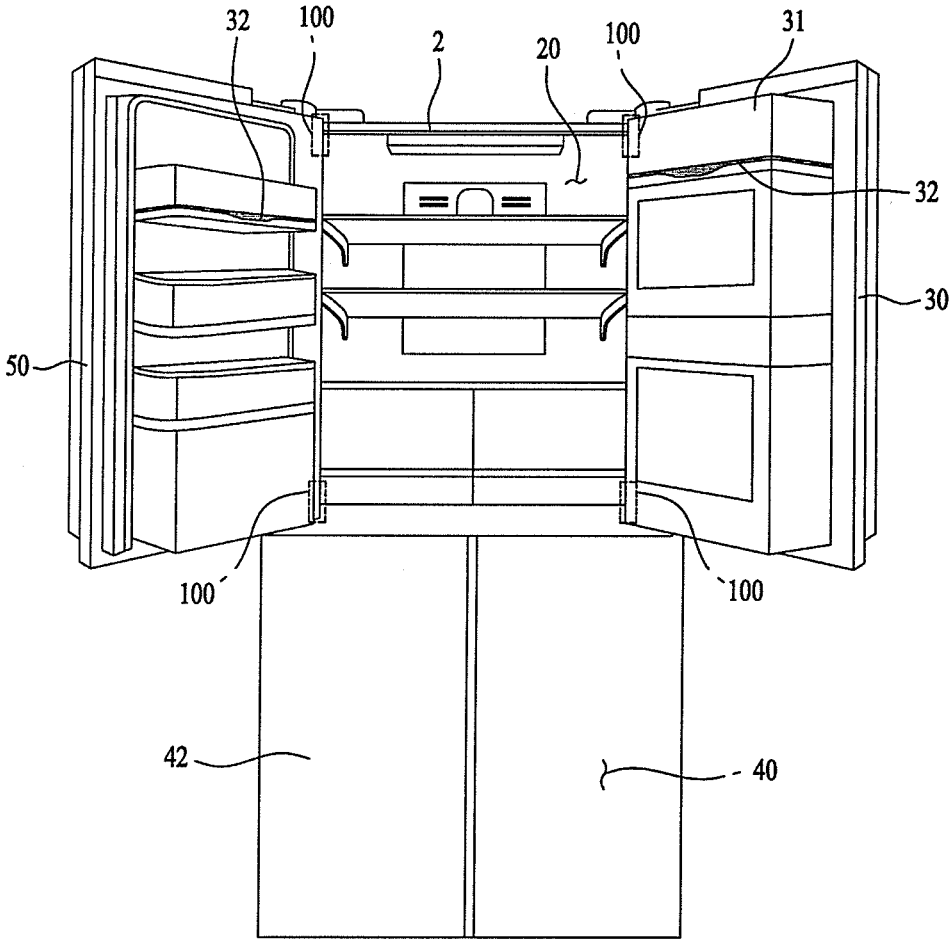
FIG. 1 is a front view of a refrigerator in accordance with an embodiment as broadly described herein.

Hereinafter, exemplary embodiments will be described with reference to the accompanying drawings. In the drawings, the shape, size, and the like of components may be exaggerated for clarity and convenience. In addition, the terms particularly defined in consideration of configurations and operations as embodied and broadly described herein may be replaced by other terms by those skilled in the art. The meanings of these terms may be construed based on the overall content as broadly described herein.

A refrigerator as embodied and broadly described herein may include a plurality of separate storage compartments, and a plurality of doors installed to independently open and close the respective storage compartments. Embodiments are not limited to the exemplary refrigerator shown in FIG. 1, but may be applied to a side by side type refrigerator in which a freezing compartment and a refrigerating compartment are defined at left and right sides, as well as any other refrigerators including a storage compartment and a door configured to open and close the storage compartment.

A refrigerator according to one embodiment as broadly described herein may include a plurality of separate storage compartments 20 and 40, which may respectively correspond to a refrigerating compartment or a freezing compartment. The refrigerator may include a main body 2 having the storage compartments 20 and 40 formed therein, and doors 30, 50 and 42 coupled to the main body 2. The storage compartment 20 may be opened and closed by the doors 30 and 50, and the storage compartment 40 may be opened and closed by the door 42.

Although a description related to the doors 30 and 50 may be equally applied to the door 42, simply for convenience of explanation, the following description will be specifically directed to the doors 30 and 50. However, those skilled in the art will understand that the same description may also be applied to the door 42.

Doors installed to open and close the storage compartment 20 may include a left door 50 coupled to the main body 2 to open a left region of the storage compartment 20 and a right door 30 coupled to the main body 2 to open a right region of the storage compartment 20. The user may simultaneously open the left door 50 and the right door 30, or may open only one of the left door 50 or the right door 30 as needed.

The doors 30 and 50 may be rotatably coupled to the main body 2 by door coupling and rotation assemblies 100 installed at a top and bottom of the left door 50 and at a top and bottom of the right door 30. In this case, a total of four door coupling and rotation assemblies 100 may couple the doors 30 and 50 to the main body 2. Hereinafter, simply for ease of discussion, these door coupling and rotation assemblies will simply be referred to as door assemblies 100.

Baskets 32 in which items may be stored may be installed on the left door 50 and the right door 30. The baskets 32 may include a peripheral wall to prevent items from falling out of the baskets 32. Some of the baskets 32 may include a cover 31 configured to open and close a top opening of the basket 32. The cover 31 may be rotatably coupled to one side of the basket 32 to allow the user to rotate the cover 31.

Figure 2:
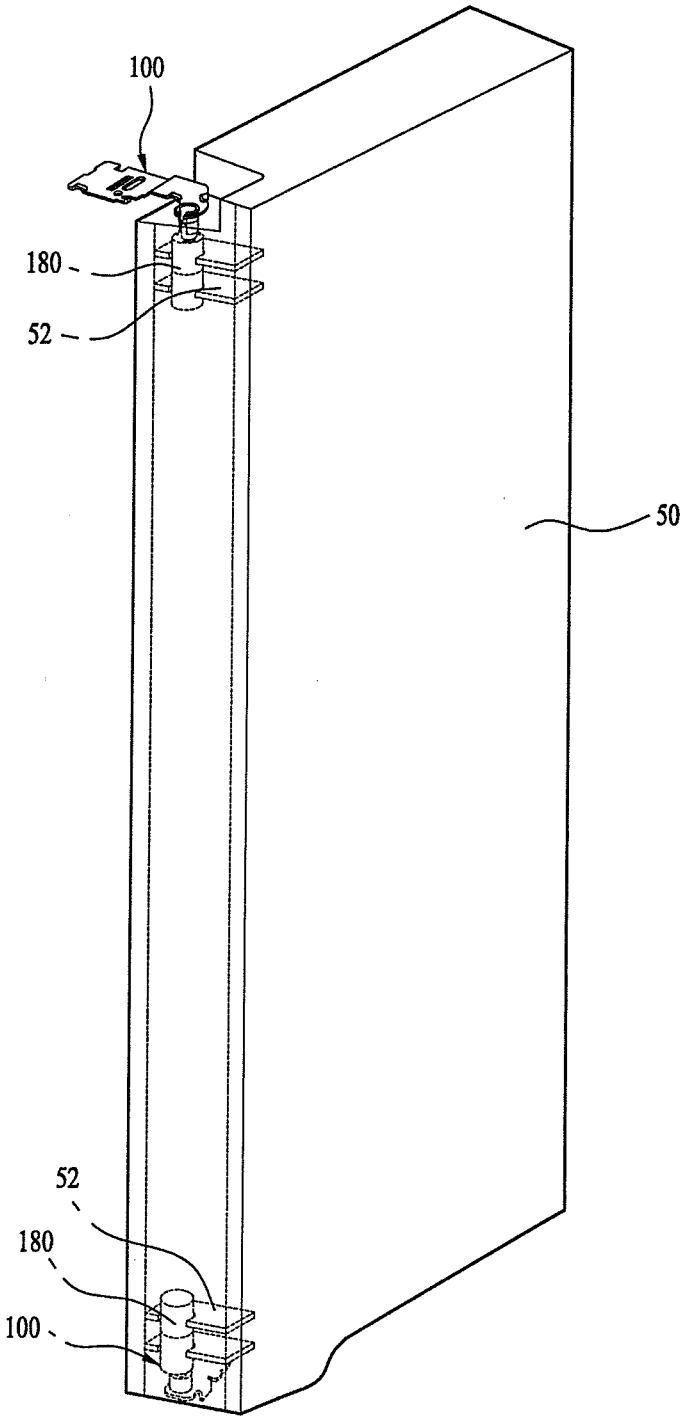
FIG. 2 is a perspective view of a door of the refrigerator shown in FIG. 1.

FIG. 2 illustrates an installation relationship of a door rotation drive device and a door. In FIG. 2, the left door 50 is illustrated, simply for ease of explanation. The door coupling assemblies 100 may be installed respectively at the top and bottom of the left door 50. Although FIG. 2 does not show the right door 30, the door coupling assemblies 100 may be installed at the right door 30 in the same manner as those of the left door 50.

The door assembly 100 may include a motor 180 embedded in the door 30 or 50. The motor 180 may be an electrically driven motor to provide the door with torque, thereby allowing the door to be pivotally rotated even if the user does not manually grip and rotate the door. Because the motor 180 is embedded in the door 30 or 50, the motor 180 does not occupy space in the storage compartment of the main body 2. Accordingly, installation of the motor 180 does not reduce usable volume of the storage compartment 20. In addition, because the size of the motor 180 is not greater than the thickness of the door 30 or 50, therefore installation of the motor 180 does not increase the thickness of the door 30 or 50. Consequently, the door 30 or 50 is not changed in shape due to the motor 180, and installation of the motor 180 does not cause variation in the capacity of the refrigerator.

One or more ribs 52 may be installed in the left door 50 to fix the motor 180 to the left door 50. The rib 52 may surround a portion of an outer circumferential surface of the motor 180, in order to increase a contact area between the motor 180 and the left door 50 so as to increase coupling force therebetween. The same rib structure may also be installed in the right door 30.

When the motor 180 is driven, the left door 50 and the motor 180 may be rotated together relative to the main body 2 to selectively open or close the storage compartment 20. In this case, through rotation of the motor 180, the rib 52 may maintain strong coupling relationship between the motor 180 and the left door 50 to ensure simultaneous rotation of the motor 180 and the left door 50. In the embodiment shown in FIG. 2, the motor 180 at the top of the door 50 and the motor 180 at the bottom of the door 50 may operate simultaneously to further enhance the smooth rotation of the door 50 relative to the main body 2.

Figure 3:
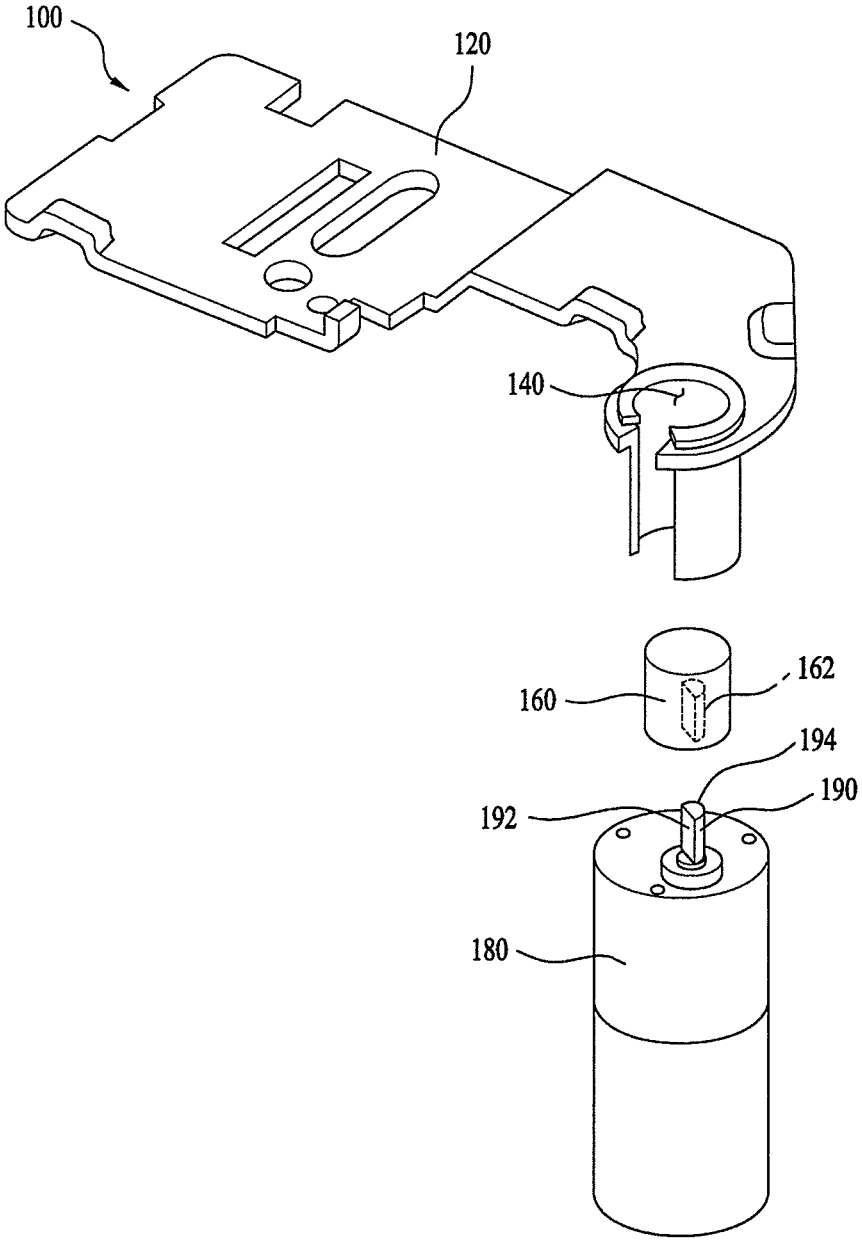
FIG. 3 is an exploded perspective view of a door rotation drive device shown in FIG. 2.
Figure 4:
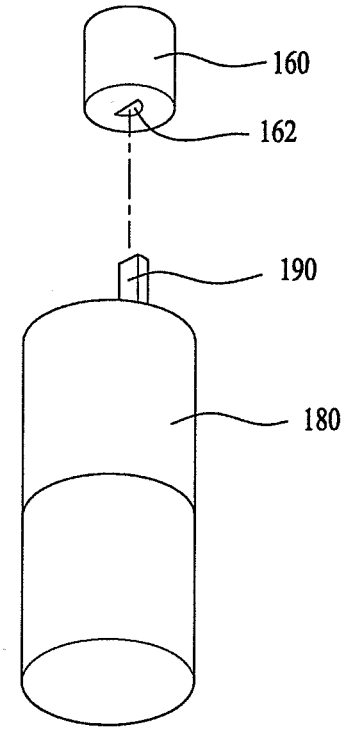
FIG. 4 is a bottom perspective view of the door rotation drive device shown in FIG. 3.

FIG. 3 is an exploded view of the door assembly, and FIG. 4 is a bottom perspective view of a door rotation drive device shown in FIG. 3.

The door assembly 100 may include a hinge bracket 120, one end of which is coupled to the main body 2, a hinge shaft 190 coupled to the hinge bracket 120, and the motor 180 coupled to the hinge shaft 190. The hinge shaft 190 may serve as a center of rotation of the door 30 or 50. The door 30 or 50 may be rotated about the hinge shaft 190 to open or close the storage compartment 20. The motor 180 may rotate about the hinge shaft 190. That is, when the motor 180 is driven, the hinge shaft 190 is not rotated, but the motor 180 is rotated, because the hinge shaft 190 remains stationary when the motor 180 is driven, and consequently, the motor 180 is rotated.

The door assembly 100 may include a link 160 coupled to the hinge bracket 120. The link 160 may couple the hinge shaft 190 and the hinge bracket 120.

The link 160 may be fixedly coupled so that it does not rotate relative to the hinge bracket 120. An accommodation recess 140 in which the link 160 is received may be formed at a second end of the hinge bracket 120. The accommodation recess 140 may have a circular cross section to surround the link 160. The link 160 may take the form of a cylinder to be received in the accommodation recess 140. Since high torque may be applied to the link 160, the link 160 may have a predetermined radius to prevent the link 160 from being damaged due to the torque.

The link 160 may have an insertion bore 162 formed therein, and the interior of the link 160 surrounding the insertion bore 162 may be solid a material to increase the strength of the link 160. The link 160 may be formed of a material having a predetermined strength, such as steel. The hinge shaft 190 may be inserted into and coupled to the insertion bore 162. The cross section of the hinge shaft 190 may have a flat face 192 and a curved face 194 having a relatively gentle curvature. That is, the hinge shaft 190 may generally have a D-shaped cross section. The insertion bore 162 may have the same cross section as that of the hinge shaft 190, and the insertion bore 162 and the hinge shaft 190 may achieve sufficiently strong coupling therebetween.

The motor 180 may be coupled to the hinge shaft 190 and be rotated about the hinge shaft 190. The motor 180 may include, for example, a rotor and a stator. The motor 180 may be a stepper motor. The stepper motor may be referred to as a pulse motor that is rotated by an angle proportional to a given pulse number based on the sequence of step pulses. A rotation angle of the door may be precisely controlled using the stepper motor.

The motor 180 may be rotated forward or in reverse. The door 30 or 50 may be rotated by torque of the motor 180, thereby opening or closing the storage compartment 20. For example, the door 30 or 50 may be rotated forward to open the storage compartment 20, and be rotated in reverse to close the storage compartment 20. Accordingly, the motor 180 may implement forward rotation as well as reverse rotation, and thus the user may open or close the door 30 or 50 without applying manual force to the door 30 or 50. That is, when the motor 180 is driven, the motor 180 and the door 30 or 50 may be rotated together relative to the hinge shaft 190. The motor 180 may be rotated relative to the link 160 in a stationary state of the link 160.

Figure 5:
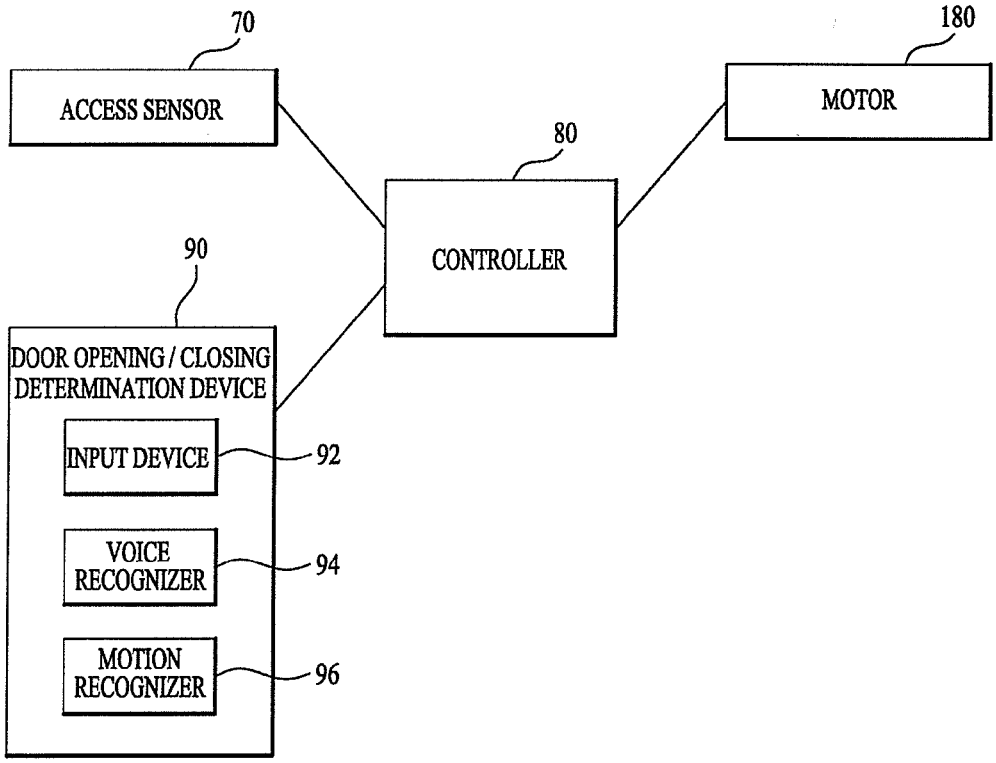
FIG. 5 is a control block diagram of the refrigerator shown in FIG. 1, in accordance with an embodiment as broadly described herein.

FIG. 5 is a control block diagram, according to an embodiment as broadly described herein.

The refrigerator may include an access sensor 70 configured to sense access, or proximity, of the user in the vicinity of the refrigerator. The access sensor 70 may sense whether the user accesses an area in front of the refrigerator, i.e. an area at a predetermined distance or less from the door 30 or 50. When the access sensor 70 senses access, or proximity, of the user, a corresponding signal may be transmitted to a controller 80. For example, the access sensor 70 may sense access, or proximity, of the user based on whether or not movement occurs within a predetermined distance range.

The refrigerator may include a door opening/closing determination device 90 configured to determine whether or not the user needs to open or close the door 30 or 50.

The user may need to open the door 30 or 50 to store items in the storage compartment 20. In addition, after the user accesses the storage compartment 20, the user may need to close the door 30 or 50 in order to prevent further leakage of cold air from the storage compartment 20.

In certain embodiments, the door opening/closing determination device 90 may be continuously driven. In alternative embodiments, the door opening/closing determination device 90 may be driven only when the access sensor 70 senses access of the user.

The door opening/closing determination device 90 may include an input device 92 which receives a user input signal. The input unit 92 may be, for example, a display installed at a front surface of the door 30 or 50. The input device 92 may include buttons to allow the user to input a signal by pushing a corresponding button of the input device 92.

Without door assembly 100 described above, the user may manually rotate the door 30 or 50 after gripping a handle provided at the door 30 or 50. However, the input device 92 may provide for input of an appropriate signal to open/close the door via simple finger touch or manipulation.

The door opening/closing determination device 90 may include a voice recognizer 94 to which a preset voice signal may be transmitted. When the user inputs a specific instruction with a preset vocal command, the voice recognizer 94 may determine whether or not a corresponding signal is generated. If a specific signal is generated, the voice recognizer 94 may provide the controller 80 with information indicating generation of the related signal.

The door opening/closing determination device 90 may include a motion recognizer 96, to which a user motion signal may be transmitted. The motion recognizer 96 may recognize that the user needs to open or close the door 30 or 50 when the user implements a specific motion. For example, when the user moves to the front of the refrigerator while holding an object with both hands, the motion recognizer 96 may recognize this user motion, thereby determining that the user needs to open the door 30 or 50.

The motion recognizer 96 may be, for example, a camera that may recognize a user motion. To control energy consumption otherwise required to continuously operate the camera in order to recognize user motion, the motion recognizer 96 may remain off, and then be driven when the access sensor 70 senses access, or proximity, of the user.

When the controller 80 generates a related signal, the controller 80 may drive the motor 180. In this case, the motor 180 may be rotated in a forward or reverse direction, and thus may open or close the door 30 or 50 as appropriate.

With reference to FIGS. 1 to 5, an operation mode of the door 30 or 50 will be described hereinafter.

The door assemblies 100 may be provided respectively at the top and bottom of each of the left door 50 and the right door 50. That is, total four motors 180 may be installed, and a single door may be rotated by two motors 180. In this case, the motor 180 provided at the top of the door 30 or 50 and the motor 180 provided at the bottom of the same door 30 or 50 may be driven in the same direction. That is, since two motors may provide torque to rotate a single door in a forward or reverse direction, the door 30 or 50 may be stably rotated the forward or reverse direction. In addition, the motor 180 provided at the top of the door 30 or 50 and the motor 180 provided at the bottom of the same door 30 or 50 may be simultaneously driven or stopped. Since a single door is provided with two motors, damage to the door may otherwise occur when two motors are operated differently.

On the other hand, the motor(s) 180 provided at the left door 50 and the motor(s) 180 provided at the right door 30 may be driven in opposite directions. The left door 50 is installed at the left side of the main body 2 so as to be rotated about a vertical axis of rotation at the left side of the main body 2. On the other hand, the right door 30 is installed at the right side of the main body 2 so as to be rotated about a vertical axis of rotation at the right side of the main body 2. Accordingly, the motor(s) 180 provided at the left door 50 and the motor(s) 180 provided at the right door 30 may be driven in appropriate directions in order to rotate the corresponding door in the desired direction.

The motor(s) 180 provided at the left door 50 and the motor(s) 180 provided at the right door 30 may be simultaneously driven. Although two motors 180 installed at a signal door may be simultaneously driven, motors 180 provided respectively at different doors may be driven with a time gap as needed.

However, in certain situations in order to provide a sufficient space for the user to access the storage compartment 20, the motor(s) 180 provided at the left door 50 and the motor(s) 180 provided at the right door 30 may be simultaneously driven to provide the largest possible access.

Figure 6:
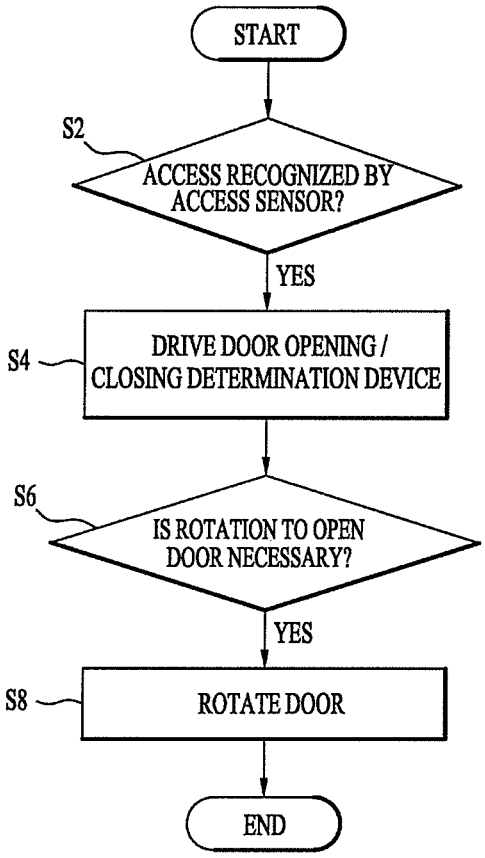
FIG. 6 is a flow chart of a control method of the refrigerator shown in FIG. 1, in accordance with an embodiment as broadly described herein.
Figure 7:
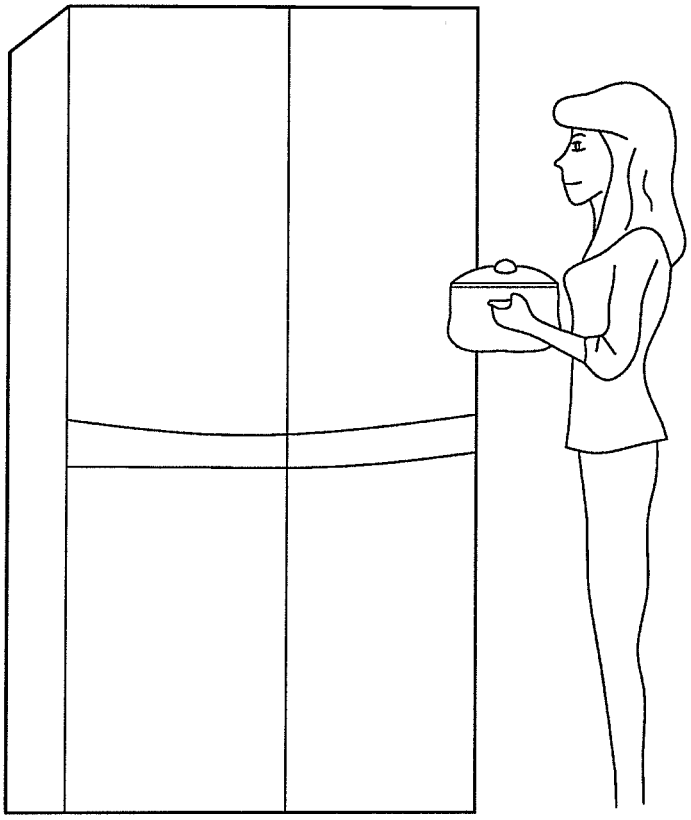
FIGS. 7 and 8 illustrate a usage scenario.
Figure 8:
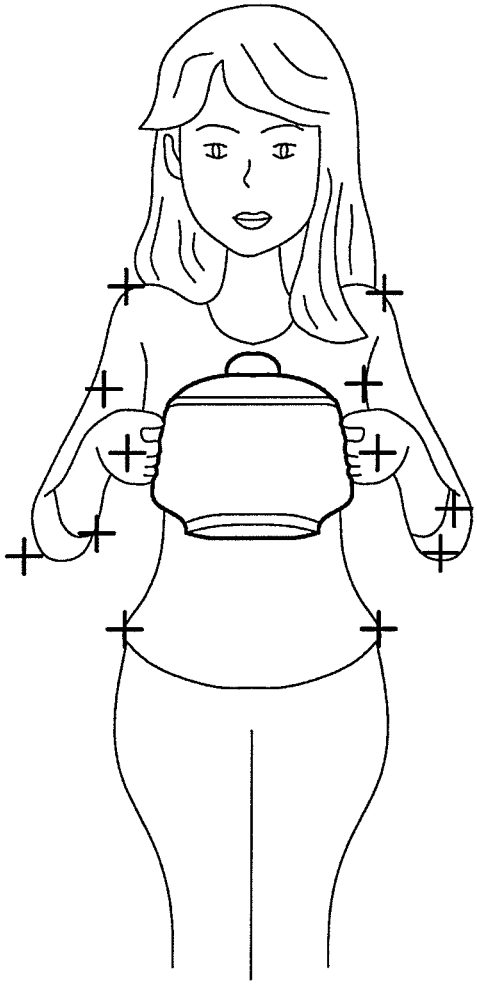

FIG. 6 is a flow chart of an automatic door opening and closing method, and FIGS. 7 and 8 illustrate user access to the storage compartment 30.

A refrigerator may be installed in a room. Therefore, although the user may move toward the refrigerator in order to access the storage compartment 20, the user may also move past the refrigerator on the way to other places in the room.

If the refrigerator door were opened every time the user simply came close to the refrigerator, the door may be unintentionally opened even when the need access to the interior of does not actually use the refrigerator. This unintentional opening of the refrigerator door may cause unnecessary leakage of cold air from the storage compartment 20 and increase in the interior temperature of the storage compartment 20, thus adversely impacting energy consumption. For this reason, the access sensor 70 and the door opening/closing determination device 90 may be provided.

First, the access sensor 70 may sense whether or not the user moves to a predetermined position with respect to the refrigerator (S2). For example, the access sensor 70 may recognize access, or appropriate proximity, of the user when movement occurs at a sensible distance from the access sensor 70. For example, if the user moves toward the refrigerator as shown in FIG. 7, the access sensor 70 may sense movement.

When access of the user is sensed, the door opening/closing determination device 90 is driven (S4). The door opening/closing determination device 90 is not continuously driven, which may reduce overall energy required to drive the door opening/closing determination device 90. That is, when access of the user is not sensed, the door opening/closing determination device 90 is not be driven. The door opening/closing determination device 90 may determine whether or not opening of the doors 30 and 50 is necessary.

As shown in FIG. 8, when the user holds an object, such as a pot, with both hands, the motion recognizer 96 may determine that opening of the doors 30 and 50 is necessary.

In certain embodiments, the user may directly input an instruction to open the doors 30 and 50 via the input device 92, or the voice recognizer 94 may recognize a preset voice instruction. That is, the motion recognizer 96, the input device 92, and the voice recognizer 94 may determine whether or not opening of the doors 30 and 50 is necessary in respective manners.

When the door opening/closing determination device 90 determines that the user needs to open the doors 30 and 50, the door opening/closing determination device 90 may transmit a related signal to the controller 80.

The controller 80 may drive the motors 180 to open the doors 30 and 50 (S8). In this case, the motors installed at the top and bottom of a single door may be simultaneously driven in the same direction. On the other hand, the motors 180 installed at the left door 50 may be simultaneously driven in a different direction than the motors 180 installed at the right door 30 so that both doors 30 and 50 are opened.

Figure 9:
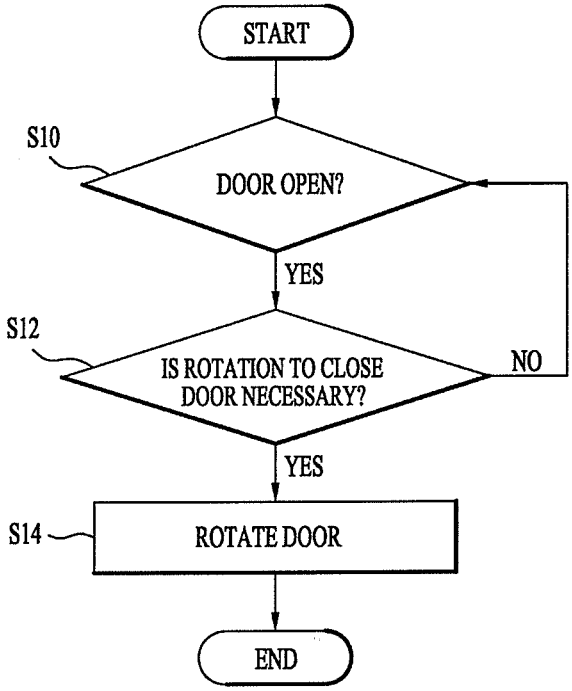
FIG. 9 is a flow chart of a control method of the refrigerator, in accordance with another embodiment as broadly described herein.

FIG. 9 is a flowchart of another method, in accordance with another embodiment as broadly described herein.

The user may open the doors 30 and 50 and thereafter introduce food into or retrieve food from the storage compartment 20, in the same manner as that of FIG. 6.

In particular, a situation in which the user has to hold food with both hands when retrieving food stored in the storage compartment 20 may occur. That is, if FIG. 8 shows a state immediately after the user retrieves food from the storage compartment 20, the user does not have a free hand to grip the handle of the door and rotate the door closed. Although the user may rotate the doors 30 and 50 closed with strong force applied in another manner and close the storage compartment 20, in this case, the doors 30 and 50 may receive unnecessarily excessive force, which may apply unnecessarily strong shock to the main body 2. Therefore, torque of the motors 180 may be used when closing the doors 30 and 50.

First, it is determined whether or not the doors 30 and 50 are open (S10). In this case, whether or not the doors 30 and 50 are open may be determined by the motors 180. That is, assuming that the motors 180 are stepper motors using pulse control, it may be recognized that the motors 180 are rotated by a specific angle. More specifically, if it is determined that a rotor is moved to a specific position, it may be recognized that the doors 30 and 50 are rotated to an open position with respect to the storage compartment 20.

On the other hand, if it is determined that the motors 180 are not rotated, it may be recognized that the doors 30 and 50 are not open.

When the doors 30 and 50 are open, it may be determined whether or not closing of the doors 30 and 50 is necessary (S12).

Since the doors 30 and 50 do not typically remain for a long time, the door opening/closing determination device 90 may be continuously driven when the doors 30 and 50 are open. Since an opening duration of the doors 30 and 50 is not excessively long, the door opening/closing determination device 90 would not be driven for an excessive time.

If the motion recognizer 96 senses that the user holds an object with both hands, if the voice recognizer 94 senses a specific user voice instruction, or if the user inputs an instruction via the input device 92, the controller 80 may drive the motors 180.

That is, if the door opening/closing determination device 90 senses that the user wishes to close the doors 30 and 50, the motors 180 may be driven to cause the doors 30 and 50 to close the storage compartment 20. In this case, the motors 180 of one door may be driven in an opposite direction to that of the other door, with two motors installed at a single door simultaneously rotated in the same direction.

In a refrigerator as embodied and broadly described herein, it may be possible to allow a user to open or close a refrigerator door without gripping the refrigerator door, which may enhance user convenience when the user introduces items into or retrieves items from a storage compartment.

In a refrigerator as embodied and broadly described herein, it may be possible to ensure efficient utilization of an interior space of the refrigerator, which may enhance storage efficiency without increasing the size of the refrigerator.

In a refrigerator as embodied and broadly described herein, the refrigerator door may be rotated via forward or reverse rotation of a motor, which may prevent damage to a main body of the refrigerator caused when the door collides with the main body.

A refrigerator as embodied and broadly described herein may provide enhanced user convenience when a user opens a refrigerator door.

A refrigerator as embodied and broadly described herein may achieve efficient utilization of an interior space and provide user convenience.

A refrigerator, as embodied and broadly described herein, may include a main body having a storage compartment in which food is stored, a door configured to open or close the storage compartment, a door assembly configured to pivotally rotatably connect the door to the main body, a door opening/closing determination unit configured to determine whether or not a user wishes to open the door, and a controller configured to drive a motor in response a signal sensed by the door opening/closing determination unit, wherein the door assembly includes a hinge bracket installed to the main body, a hinge shaft coupled to the hinge bracket, the hinge shaft serving as a rotation center of the door, and a motor installed to the door to rotate the door forward or in reverse, the motor being rotated relative to the hinge shaft.

The motor and the door may be rotated together relative to the hinge shaft when the motor is driven.

The refrigerator may further include a link fixed to the hinge bracket, and the hinge shaft may be fixed to the link.

The link may have an insertion bore, and the hinge shaft may be inserted into and fixed to the insertion bore.

The motor may be a stepper motor.

The door opening/closing determination unit may include an input unit, to which a user input signal is transmitted.

The door opening/closing determination unit may include a voice recognizer, to which a preset user voice instruction signal is transmitted.

The door opening/closing determination unit may include a motion recognizer, to which a user motion signal is transmitted.

The motion recognizer may recognize whether or not the user holds an object with both hands.

The door opening/closing determination unit may be driven in an open state of the door, and the door opening/closing determination unit may determine whether or not the user wishes to close the door.

The controller may drive the motor to close the door when the door opening/closing determination unit senses that the user wishes to close the door.

The refrigerator may further include an access sensing unit configured to sense access of the user in the vicinity of the refrigerator, and the door opening/closing determination unit may be driven when the access sensing unit recognizes access of the user.

The door assembly may be provided at each of the top and bottom of the door.

The motor provided at the top of the door and the motor provided at the bottom of the motor may be simultaneously driven.

The door may include a left door configured to open a left region of the storage compartment and a right door configured to open a right region of the storage compartment, and the door assembly may be provided at each of the left door and the right door.

The motors provided at the left door and the right door may be driven in opposite directions.

The motors provided at the left door and the right door may be simultaneously driven.

A door assembly for a refrigerator, in accordance with another embodiment as broadly described herein, may include a hinge bracket installed to a main body having a storage compartment, a hinge shaft pivotally rotatably coupled to the hinge bracket, the hinge shaft serving as a rotation center of the door, and a motor installed to a door configured to open or close the storage compartment, the motor serving to rotate the door forward or in reverse and being rotated relative to the hinge shaft, wherein the door and the motor are rotated relative to the hinge shaft when the motor is driven.

The hinge shaft may serve as a rotation center of the door.

The motor may be rotated in a stationary state of the hinge shaft when the motor is driven.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A door assembly for a refrigerator, comprising:

a hinge bracket having a first end fixed to a main body, the main body having a storage compartment formed therein and a door rotatably coupled thereto to open and close the storage compartment;

a hinge shaft fixed to a second end of the hinge bracket, the hinge shaft defining an axis of rotation of the door;

a motor provided in the door and rotatably coupled to the hinge shaft so as to rotate the door in a forward direction or a reverse direction about the hinge shaft, wherein the door and the motor are rotated together relative to the hinge shaft when the motor is driven, a link which fixes the hinge shaft to the second end of the hinge bracket; and a bore extending into the link, wherein the hinge shaft is received in the bore, and wherein a cross section of the bore including at least one flat section and at least one curved section so as to correspond to a cross section of the hinge shaft such that the hinge shaft remains stationary with the link and the hinge bracket fixed to the main body as the motor rotates with the door about the hinge shaft.

2. The door assembly of claim 1, wherein the motor is a stepper motor that is driven in a first direction in response to a command to rotate the door in a first direction to open the door relative to the storage compartment, and is driven in a second direction in response to a command to rotate the door in a second direction to close the door relative to the storage compartment.

3. A refrigerator, comprising:

a main body having a storage compartment formed therein;

at least one door coupled to the main body and configured to open and close the storage compartment;

a door assembly configured to rotatably couple the at least one door to the main body;

a door opening/closing determination device configured to determine whether or not a door rotation signal is received; and a controller configured to rotate the door in response to the door rotation signal received by the door opening/closing determination device, wherein the door assembly includes a hinge bracket having a first end coupled to the main body, a hinge shaft fixed to a second end of the hinge bracket, wherein the hinge shaft defines an axis of rotation of the at least one door, and a motor installed in the at least one door, wherein the motor rotates within the at least one door relative to the fixed hinge shaft so as to rotate the at least one door in a first direction to open the door or in a second direction to close the at least one door, based on the received door rotation signal, wherein the at least one door includes:

a first door coupled to a first vertical side edge portion of the main body to open and close a first region of the storage compartment, and a second door coupled to a second vertical side edge portion of the main body to open and close a second region of the storage compartment, and wherein the door assembly includes a first door assembly that rotatably couples the first door to the main body, and a second door assembly that rotatbly couples the second door to the main body.

4. The refrigerator of claim 3, further comprising an access sensor configured to sense a user in an access area of the refrigerator;

wherein the door opening/closing determination device is driven when the access sensor senses a user in the access area of the refrigerator.

5. The refrigerator of claim 3, wherein the motor and the at least one door are rotated together about the hinge shaft when the motor is driven.

6. The refrigerator of claim 3, further comprising a link fixed to the second end of the hinge bracket, wherein the hinge shaft is fixed to the link.

7. The refrigerator of claim 6, further comprising an insertion bore extending into the link, wherein the hinge shaft is inserted into and fixed in the insertion bore.

8. The refrigerator of claim 3, wherein the motor is a stepper motor.

9. The refrigerator of claim 3, wherein the door opening/closing determination device includes a motion recognizer configured to receive an external motion signal corresponding to the door rotation signal.

10. The refrigerator of claim 9, wherein the motion recognizer is configured to recognize a user holding a storage object with two hands, and to transmit a corresponding door rotation signal.

11. The refrigerator of claim 3, wherein the door opening/closing determination device is driven when the at least one door is in an open state to determine whether or not a signal to close the at least one door is received.

12. The refrigerator of claim 11, wherein the controller drives the motor to close the at least one door in response to a signal sensed by the door opening/closing determination device to close the at least one door.

13. The refrigerator of claim 3, wherein the door assembly comprises a first door assembly provided a top end of the at least one door and a second door assembly provided at a bottom end of the at least one door, with a first motor provided at the top end of the at least one door with the first door assembly and a second motor provided at the bottom end of the at least one door with the second door assembly, wherein the first and second motors are simultaneously driven.

14. The refrigerator of claim 3, wherein the motor of the door assembly comprises at least one first motor provided at the first door and at least one second motor provided at the second door, and wherein the at least one first motor provided at the first door and the at least one second motor provided at the second door are driven in opposite directions to open the first and second doors, and are driven in opposite directions to close the first and second doors.

15. The refrigerator of claim 14, wherein the at least one first motor comprises a pair of first motors provided at the first door that are simultaneously driven in the same direction, and the at least one second motor comprises a pair of second motors provided at the second door that are simultaneously driven in the same direction.

* * * * *